US011215939B2

(12) United States Patent
Ajima

(10) Patent No.: US 11,215,939 B2
(45) Date of Patent: Jan. 4, 2022

(54) IMAGE FORMING APPARATUS AND METHOD FOR CONTROLLING IMAGE FORMING APPARATUS

(71) Applicant: TOSHIBA TEC KABUSHIKI KAISHA, Tokyo (JP)

(72) Inventor: Hisanobu Ajima, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/988,784

(22) Filed: Aug. 10, 2020

(65) Prior Publication Data

US 2021/0263444 A1 Aug. 26, 2021

(30) Foreign Application Priority Data

Feb. 25, 2020 (JP) ..... JP2020-029174

(51) Int. Cl.
*G03G 15/08* (2006.01)
*G03G 15/00* (2006.01)

(52) U.S. Cl.
CPC ..... *G03G 15/0849* (2013.01); *G03G 15/0863* (2013.01); *G03G 15/556* (2013.01)

(58) Field of Classification Search
None
See application file for complete search history.

(56) References Cited

U.S. PATENT DOCUMENTS 9,046,816 B2 6/2015 Ajima
2013/0223855 A1* 8/2013 Ajima ..... G03G 15/0849 399/27

FOREIGN PATENT DOCUMENTS

| | | |
|---|---|---|
| JP | 2001-228691 | 8/2001 |
| JP | 2005-173088 | 6/2005 |
| JP | 2014-077884 | 5/2014 |
| JP | 2015-022238 | 2/2015 |

* cited by examiner

*Primary Examiner* — Jas A Sanghera
(74) *Attorney, Agent, or Firm* — Amin, Turocy & Watson, LLP

(57) ABSTRACT

According to one embodiment, an apparatus includes a photoconductor, an exposure device, a developing device, a toner concentration sensor, a supply motor, and a processor. The exposure device exposes the photoconductor based on image data. The developing device forms a toner image on the photoconductor with toner supplied from a toner cartridge. The toner concentration sensor detects a toner concentration in the developing device. The supply motor supplies the toner from the toner cartridge to the developing device based on the toner concentration. The processor detects a toner container supply abnormality based on a toner supply rate and a print rate of the image data, the toner supply rate being calculated based on a pixel count value that is an integrated value of pixel values of the image data and a supply motor count value that is an integrated value of drive times of the supply motor.

20 Claims, 7 Drawing Sheets

IMAGE FORMING APPARATUS AND METHOD FOR CONTROLLING IMAGE FORMING APPARATUS

CROSS-REFERENCE TO RELATED APPLICATION

This application is based upon and claims the benefit of priority from Japanese Patent Application No. 2020-029174, filed Feb. 25, 2020, the entire contents of which are incorporated herein by reference.

FIELD

Embodiments described herein relate generally to an image forming apparatus and a method for controlling an image forming apparatus.

BACKGROUND

An image forming apparatus receives toner from a toner cartridge and performs an image forming process of forming a toner image on a photoconductive drum. The image forming apparatus transfers the toner image on the photoconductive drum onto a print medium.

The image forming apparatus estimates the remaining amount of toner in the toner cartridge based on the drive amount (toner supply motor count value) of a motor (toner supply motor) for driving a screw (delivery mechanism) that sends toner from the toner cartridge to the image forming apparatus. When the toner supply motor count value becomes equal to or higher than a near-empty threshold, the image forming apparatus detects a near-empty toner indicating that the remaining amount of the toner in the toner cartridge is low.

The image forming apparatus includes a toner concentration sensor that detects a toner concentration in a developing device that receives toner from the toner cartridge. The image forming apparatus supplies the toner by using the toner supply motor when it is detected that the toner concentration decreases. When the toner concentration is not restored even after operating the toner supply motor, the image forming apparatus detects an empty toner indicating that the toner in the toner cartridge is empty.

For example, there are cases where a toner container supply abnormality occurs, such as an abnormality of the delivery mechanism of a toner cartridge, a state where the sealing material that covers a toner supply port of the toner cartridge is still attached, a state where the toner cartridge has a high temperature during storage and the toner is solidified, and the like. When such a toner container supply abnormality occurs, the toner concentration is not restored even if the toner supply motor is operated. However, there is a problem that a user may not be aware that a toner container supply abnormality occurs until an empty toner is detected.

DETAILED DESCRIPTION

An aspect of an exemplary embodiment is to provide an image forming apparatus that detects a toner supply abnormality in a toner cartridge and a method for controlling an image forming apparatus.

In general, according to one embodiment, an image forming apparatus includes a photoconductive image carrier, an exposure device, a developing device, a toner concentration sensor, a toner supply motor, and a processor. The exposure device exposes the photoconductive image carrier based on image data. The developing device forms a toner image on the photoconductive image carrier with toner supplied from a toner cartridge. The toner concentration sensor detects a toner concentration in the developing device. The toner supply motor supplies the toner from the toner cartridge to the developing device based on the toner concentration. The processor detects a toner container supply abnormality based on a toner supply rate and a print rate of the image data, the toner supply rate being calculated based on a pixel count value that is an integrated value of pixel values of the image data and a toner supply motor count value that is an integrated value of drive times of the toner supply motor.

Hereinafter, an image forming apparatus and a method for controlling an image forming apparatus according to an embodiment will be described with reference to drawings.

Figure 1:
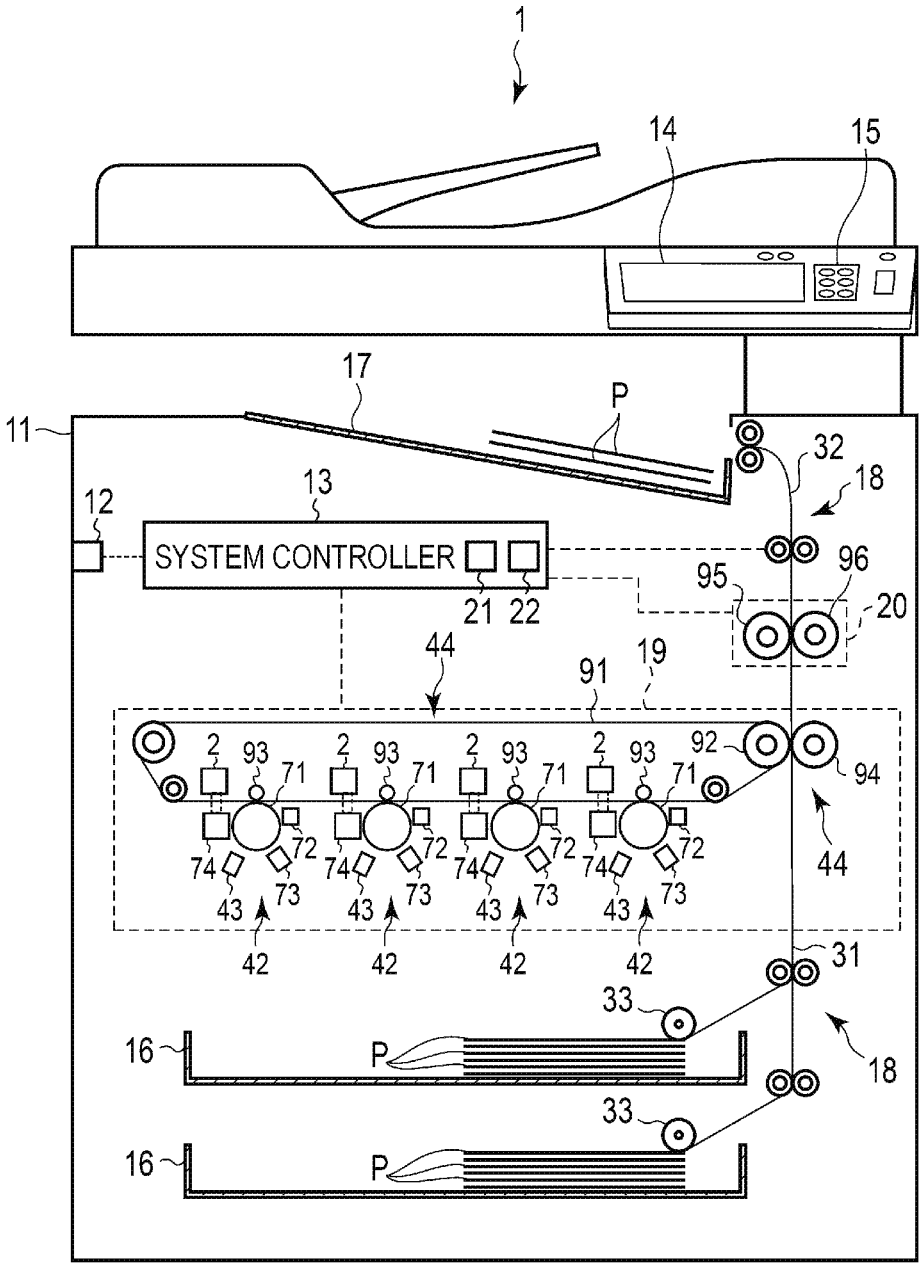
FIG. 1 is a diagram illustrating a configuration example of an image forming apparatus according to an embodiment.

FIG. 1 is an explanatory diagram illustrating a configuration example of an image forming apparatus 1 according to the embodiment.

The image forming apparatus 1 is, for example, a multifunction printer (MFP) that performs various kinds of processing such as image formation while conveying a recording medium such as a print medium. The image forming apparatus 1 is, for example, a solid-state scanning printer (for example, an LED printer) that scans an LED array that performs various kinds of processing such as image formation while conveying a recording medium such as a print medium.

For example, the image forming apparatus 1 is configured to receive toner from a toner cartridge 2 and form an image on a print medium with the received toner. The toner may be a monochromatic toner, or may be a color toner of colors such as cyan, magenta, yellow, and black.

As illustrated in FIG. 1, the image forming apparatus 1 includes a housing 11, a communication interface 12, a system controller 13, a display unit 14, an operation interface 15, a plurality of paper trays 16, a paper discharge tray 17, a conveying unit 18, an image forming unit 19, and a fixing device 20.

The housing 11 is the main body of the image forming apparatus 1. The housing 11 houses the communication interface 12, the system controller 13, the display unit 14, the operation interface 15, the plurality of paper trays 16, the paper discharge tray 17, the conveying unit 18, the image forming unit 19, and the fixing device 20.

The communication interface 12 is an interface for communicating with other devices. The communication interface 12 is used, for example, for communication with a host device (external device). The communication interface 12 is configured as a LAN connector or the like, for example. Further, the communication interface 12 may be one that performs wireless communication with another device according to a standard such as Bluetooth (registered trademark) or Wi-fi (registered trademark).

The system controller 13 controls the image forming apparatus 1. The system controller 13 includes, for example, a processor 21 and a memory 22.

The processor 21 is an arithmetic element that executes arithmetic processing. The processor 21 is, for example, a CPU. The processor 21 performs various kinds of processing based on data such as programs stored in the memory 22. The processor 21 functions as a control unit capable of executing various operations by executing the programs stored in the memory 22.

The memory 22 is a storage medium that stores programs and data used in the programs. The memory 22 also functions as a working memory. That is, the memory 22 temporarily stores data being processed by the processor 21, a program executed by the processor 21, and the like.

The processor 21 executes various information processings by executing the programs stored in the memory 22. For example, the processor 21 generates a print job based on an image acquired from an external device via the communication interface 12, for example. The processor 21 stores the generated print job in the memory 22.

The print job includes image data indicating an image to be formed on a print medium P. The image data may be data for forming an image on one print medium P, or may be data for forming an image on a plurality of print media P. Further, the print job includes information indicating color print or monochrome print.

The processor 21 also functions as a controller (engine controller) that controls the operations of the conveying unit 18, the image forming unit 19, and the fixing device 20 by executing the programs stored in the memory 22. That is, the processor 21 controls the conveyance of the print medium P by the conveying unit 18, the image formation on the print medium P by the image forming unit 19, and the fixing of the image on the print medium P by the fixing device 20.

The image forming apparatus 1 may be configured to include an engine controller separately from the system controller 13. In this case, the engine controller controls the conveyance of the print medium P by the conveying unit 18, the image formation on the print medium P by the image forming unit 19, and the fixing of the image on the print medium P by the fixing device 20. In this case, the system controller 13 also supplies the engine controller with information necessary for control by the engine controller.

The display unit 14 includes a display that displays a screen according to a video signal input from a display control unit such as the system controller 13 or a graphic controller (not illustrated). For example, on the display of the display unit 14, a screen for various settings of the image forming apparatus 1 and information such as the remaining amount of toner are displayed.

The operation interface 15 is connected to an operation member (not illustrated). The operation interface 15 supplies an operation signal according to the operation of the operation member to the system controller 13. The operation member is, for example, a touch sensor, a numeric keypad, a power key, a paper feed key, various function keys, or a keyboard. The touch sensor acquires information indicating a designated position in a certain area. The touch sensor is configured as a touch panel integrated with the display unit 14 to input a signal indicating the touched position on the screen displayed on the display unit 14 to the system controller 13.

The plurality of paper trays 16 are cassettes that house the print media P. The paper tray 16 is configured to be able to supply the print medium P from outside the housing 11. For example, the paper tray 16 is configured to be pulled out from the housing 11.

The paper discharge tray 17 is a tray that supports the print medium P discharged from the image forming apparatus 1.

Next, a configuration for conveying the print medium P of the image forming apparatus 1 will be described.

The conveying unit 18 is a mechanism that conveys the print medium P in the image forming apparatus 1. As illustrated in FIG. 1, the conveying unit 18 includes a plurality of conveyance paths. For example, the conveying unit 18 includes a paper feed conveyance path 31 and a paper discharge conveyance path 32.

The paper feed conveyance path 31 and the paper discharge conveyance path 32 are each configured with a plurality of motors, a plurality of rollers, and a plurality of guides, which are not illustrated. Under the control of the system controller 13, the plurality of motors rotate a shaft, thereby rotating the rollers that interlock with the rotation of the shaft. The plurality of rollers move the print medium P by rotating. The plurality of guides control a conveyance direction of the print medium P.

The paper feed conveyance path 31 picks up the print medium P from the paper tray 16 and supplies the picked print medium P to the image forming unit 19. The paper feed conveyance path 31 includes a pickup roller 33 corresponding to each paper tray. Each pickup roller 33 picks up the print medium P on the paper tray 16 into the paper feed conveyance path 31.

The paper discharge conveyance path 32 is a conveyance path for discharging the print medium P on which an image is formed from the housing 11. The print medium P discharged by the paper discharge conveyance path 32 is supported by the paper discharge tray 17.

Next, the image forming unit 19 will be described.

The image forming unit 19 is configured to form an image on the print medium P. Specifically, the image forming unit 19 forms an image on the print medium P based on the print job generated by the processor 21.

The image forming unit 19 includes a plurality of loading units 41, a plurality of process units 42, a plurality of exposure devices 43, and a transfer mechanism 44. The image forming unit 19 includes the loading unit 41 and the exposure device 43 for each process unit 42. Since the plurality of process units 42, the plurality of loading units 41, and the plurality of exposure devices 43 each have the same configuration, one process unit 42, one loading unit 41, and one exposure device 43 will be described as an example.

Figure 2:
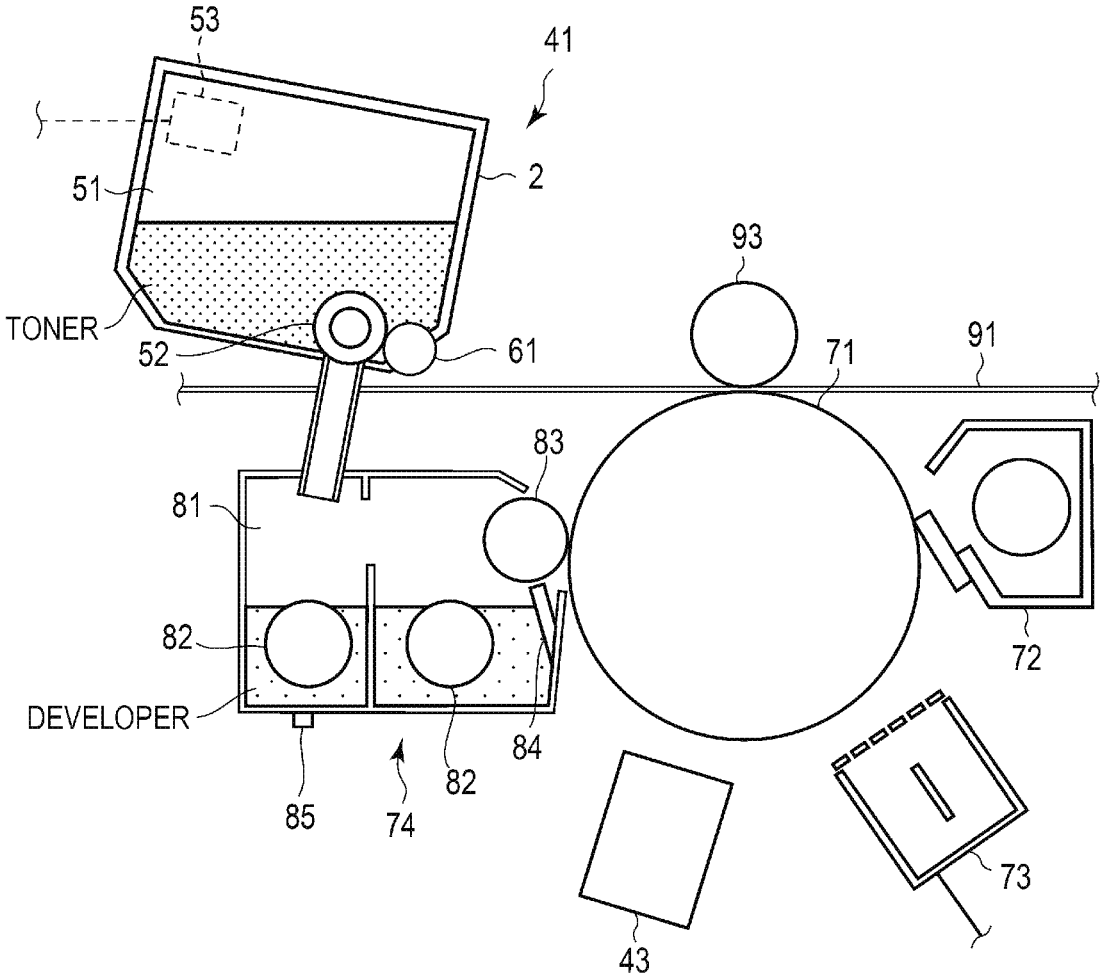
FIG. 2 is a diagram illustrating a partial configuration example of an image forming unit.

FIG. 2 is an explanatory diagram illustrating an example of a partial configuration of the image forming unit 19.

First, the toner cartridge 2 mounted in the loading unit 41 will be described.

As illustrated in FIG. 2, the toner cartridge 2 includes a toner storage container 51, a toner delivery mechanism 52, and a memory 53.

The toner storage container 51 is a container that stores toner.

The toner delivery mechanism 52 is a mechanism for delivering the toner in the toner storage container 51. The toner delivery mechanism 52 is, for example, a screw provided in the toner storage container 51 and delivering the toner by rotating.

The memory 53 stores various control data in advance. The memory 53 is incorporated in, for example, an IC chip (not illustrated) and mounted in the toner cartridge 2. The control data stored in the memory 53 is, for example, "identification code", "toner supply motor count value", "near-empty threshold", and the like. The "identification code" indicates the type and model number of the toner cartridge 2. The "toner supply motor count value" is an integrated value of drive times in which the toner cartridge 2 is driven by a toner supply motor described later. The "near-empty threshold" is a threshold that causes the image forming apparatus 1 to determine whether or not the remaining amount of toner in the toner cartridge 2 is low.

Next, the loading unit 41 in which the toner cartridge 2 is mounted will be described.

As illustrated in FIG. 2, the loading unit 41 is a module in which the toner cartridges 2 each filled with toner are mounted. The plurality of loading units 41 each include a space in which the toner cartridge 2 is mounted and a toner supply motor 61. The plurality of loading units 41 each include a communication interface (not illustrated) that connects the memory 53 of the toner cartridge 2 and the system controller 13 to each other.

The toner supply motor 61 drives the toner delivery mechanism 52 of the toner cartridge 2 under the control of the processor 21. The toner supply motor 61 is connected to the toner delivery mechanism 52 of the toner cartridge 2 when the toner cartridge 2 is loaded in the loading unit 41. Under the control of the processor 21, the toner supply motor 61 rotates the shaft thereof by being energized to drive the toner delivery mechanism 52 of the toner cartridge 2. The toner supply motor 61 drives the toner delivery mechanism 52 to supply the toner in the toner storage container 51 to a developing device described later.

Next, the process unit 42 will be described.

The process unit 42 is configured to form a toner image. For example, the plurality of process units 42 are provided for each type of toner. For example, the plurality of process units 42 respectively correspond to color toners such as cyan, magenta, yellow, and black. Specifically, the toner cartridges 2 having different color toners are connected to the respective process units 42.

As illustrated in FIG. 2, the process unit 42 includes a photoconductive drum 71 as a photoconductive image carrier, a cleaner 72, a charging charger 73, and a developing device 74.

The photoconductive drum 71 is a photoconductor including a cylindrical drum and a photoconductive layer formed on the outer peripheral surface of the drum. The photoconductive drum 71 rotates at a constant speed by a drive mechanism (not illustrated).

The cleaner 72 removes the toner remaining on the surface of the photoconductive drum 71.

The charging charger 73 uniformly charges the surface of the photoconductive drum 71. For example, the charging charger 73 charges the photoconductive drum 71 to a uniform negative potential by applying a voltage to the photoconductive drum 71 by using a charging roller. The charging roller is rotated by the rotation of the photoconductive drum 71 while applying a predetermined pressure to the photoconductive drum 71.

The developing device 74 is a device that attaches toner to the photoconductive drum 71. The developing device 74 includes a developer container 81, a stirring mechanism 82, a developing roller 83, a doctor blade 84, an automatic toner control (ATC) sensor 85, and the like.

The developer container 81 is a container for containing a developer containing toner and carrier. The developer container 81 receives the toner sent from the toner cartridge 2 by the toner delivery mechanism 52. The carrier is contained in the developer container 81 when the developing device 74 is manufactured.

The stirring mechanism 82 is driven by a motor (not illustrated) to stir the toner and the carrier in the developer container 81.

The developing roller 83 rotates in the developer container 81 to attach the developer to the surface.

The doctor blade 84 is a member disposed at a predetermined distance from the surface of the developing roller 83. The doctor blade 84 removes a part of the developer adhered to the surface of the rotating developing roller 83. As a result, a developer layer having a thickness corresponding to the distance between the doctor blade 84 and the surface of the developing roller 83 is formed on the surface of the developing roller 83.

The ATC sensor 85 is, for example, a magnetic flux sensor having a coil and detecting a voltage value generated in the coil. The detected voltage of the ATC sensor 85 changes depending on the density of magnetic flux from the toner inside the developer container 81. That is, the ATC sensor 85 detects a voltage according to the concentration ratio of the toner in the developer container 81 to the carrier (simply referred to as toner concentration). The system controller 13 can determine the toner concentration in the developer container 81 based on the detected voltage of the ATC sensor 85.

Next, the exposure device 43 will be described.

The exposure device 43 includes a plurality of light emitting elements. The exposure device 43 forms a latent image on the photoconductive drum 71 by irradiating the charged photoconductive drum 71 with light from the light-emitting element. The light emitting element is, for example, a light emitting diode (LED) or a laser diode (LD). One light-emitting element is configured to irradiate one point on the photoconductive drum 71 with light. The plurality of light emitting elements are arranged in the main scanning direction which is a direction parallel to the rotation axis of the photoconductive drum 71.

The exposure device 43 forms a latent image for one line on the photoconductive drum 71 by irradiating the photoconductive drum 71 with light by a plurality of light emitting elements arranged in the main scanning direction. Further, the exposure device 43 continuously irradiates the rotating photoconductive drum 71 with light to form a latent image of a plurality of lines.

In the above configuration, when the surface of the photoconductive drum 71 charged by the charging charger 73 is irradiated with light from the exposure device 43, an electrostatic latent image is formed. When the developer layer formed on the surface of the developing roller 83 approaches the surface of the photoconductive drum 71, the toner contained in the developer adheres to the latent image formed on the surface of the photoconductive drum 71. As a result, a toner image is formed on the surface of the photoconductive drum 71.

Next, the transfer mechanism 44 will be described.

The transfer mechanism 44 is configured to transfer the toner image formed on the surface of the photoconductive drum 71 to the print medium P.

As illustrated in FIGS. 1 and 2, the transfer mechanism 44 includes, for example, a primary transfer belt 91, a secondary transfer counter roller 92, a plurality of primary transfer rollers 93, and a secondary transfer roller 94.

The primary transfer belt 91 is an endless belt wound around the secondary transfer counter roller 92 and a plurality of winding rollers. The inner surface (inner peripheral surface) of the primary transfer belt 91 comes into contact with the secondary transfer counter roller 92 and the plurality of winding rollers, and the outer surface (outer peripheral surface) thereof faces the photoconductive drum 71 of the process unit 42.

The secondary transfer counter roller 92 is rotated by a motor (not illustrated). The secondary transfer counter roller 92 rotates to convey the primary transfer belt 91 in a predetermined conveyance direction. The plurality of winding rollers are configured to be freely rotatable. The plurality of winding rollers rotate according to the movement of the primary transfer belt 91 by the secondary transfer counter roller 92.

The plurality of primary transfer rollers 93 are configured to bring the primary transfer belt 91 into contact with the photoconductive drum 71 of the process unit 42. The plurality of primary transfer rollers 93 are provided so as to correspond to the photoconductive drums 71 of the plurality of process units 42. Specifically, the plurality of primary transfer rollers 93 are provided at positions facing the corresponding photoconductive drums 71 of the process units 42 with the primary transfer belt 91 interposed therebetween. The primary transfer roller 93 comes into contact with the inner peripheral surface side of the primary transfer belt 91 and displaces the primary transfer belt 91 toward the photoconductive drum 71 side. As a result, the primary transfer roller 93 brings the outer peripheral surface of the primary transfer belt 91 into contact with the photoconductive drum 71.

The secondary transfer roller 94 is provided at a position facing the primary transfer belt 91. The secondary transfer roller 94 comes into contact with the outer peripheral surface of the primary transfer belt 91 and applies pressure thereto. As a result, a transfer nip in which the secondary transfer roller 94 and the outer peripheral surface of the primary transfer belt 91 are in close contact with each other is formed. When the print medium P passes through the transfer nip, the secondary transfer roller 94 presses the print medium P passing through the transfer nip against the outer peripheral surface of the primary transfer belt 91.

The secondary transfer roller 94 and the secondary transfer counter roller 92 rotate to convey the print medium P supplied from the paper feed conveyance path 31 in a sandwiched state. As a result, the print medium P passes through the transfer nip.

In the above configuration, when the outer peripheral surface of the primary transfer belt 91 comes in contact with the photoconductive drum 71, the toner image formed on the surface of the photoconductive drum is transferred to the outer peripheral surface of the primary transfer belt 91. As illustrated in FIG. 1, when the image forming unit 19 includes a plurality of process units 42, the primary transfer belt 91 receives the toner images from the photoconductive drums 71 of the plurality of process units 42. The toner image transferred to the outer peripheral surface of the primary transfer belt 91 is conveyed by the primary transfer belt 91 to a transfer nip in which the secondary transfer roller 94 and the outer peripheral surface of the primary transfer belt 91 are in close contact with each other. When the print medium P is present in the transfer nip, the toner image transferred to the outer peripheral surface of the primary transfer belt 91 is transferred to the print medium P at the transfer nip.

Next, a configuration relating to the fixing of the image forming apparatus 1 will be described.

The fixing device 20 melts the toner transferred to the print medium P to fix the toner image. The fixing device 20 operates under the control of the system controller 13. The fixing device 20 includes a heating member that applies heat to the print medium P and a pressing member that applies pressure to the print medium P. For example, the heating member is a heat roller 95, for example. Further, for example, the pressing member is a press roller 96.

The heat roller 95 is a fixing rotator that is rotated by a motor (not illustrated). The heat roller 95 has a hollow cored bar made of metal, and an elastic layer formed on the outer periphery of the cored bar. The heat roller 95 is heated to a high temperature by a heater disposed inside the hollow cored bar. The heater is, for example, a halogen heater. Further, the heater may be an induction heating (IH) heater that heats the cored bar by electromagnetic induction.

The press roller 96 is provided at a position facing the heat roller 95. The press roller 96 has a cored bar made of metal having a predetermined outer diameter, and an elastic layer formed on the outer periphery of the cored bar. The press roller 96 applies pressure to the heat roller 95 by the stress applied from a tension member (not illustrated). By applying pressure from the press roller 96 to the heat roller 95, a nip (fixing nip) in which the press roller 96 and the heat roller 95 are in close contact with each other is formed. The press roller 96 is rotated by a motor (not illustrated). The press roller 96 rotates to move the print medium P entering the fixing nip and press the print medium P against the heat roller 95.

With the above configuration, the heat roller 95 and the press roller 96 apply heat and pressure to the print medium P passing through the fixing nip. As a result, the toner image is fixed on the print medium P that passes through the fixing nip. The print medium P that passes through the fixing nip is introduced into the paper discharge conveyance path 32 and discharged to the outside of the housing 11. The fixing device 20 is not limited to the above configuration. The fixing device 20 may be configured by an on-demand method in which heat is applied to the print medium P on which the toner image is transferred via a film-shaped member to melt and fix the toner.

Next, control of the image forming apparatus 1 by the system controller 13 will be described.

Figure 3:
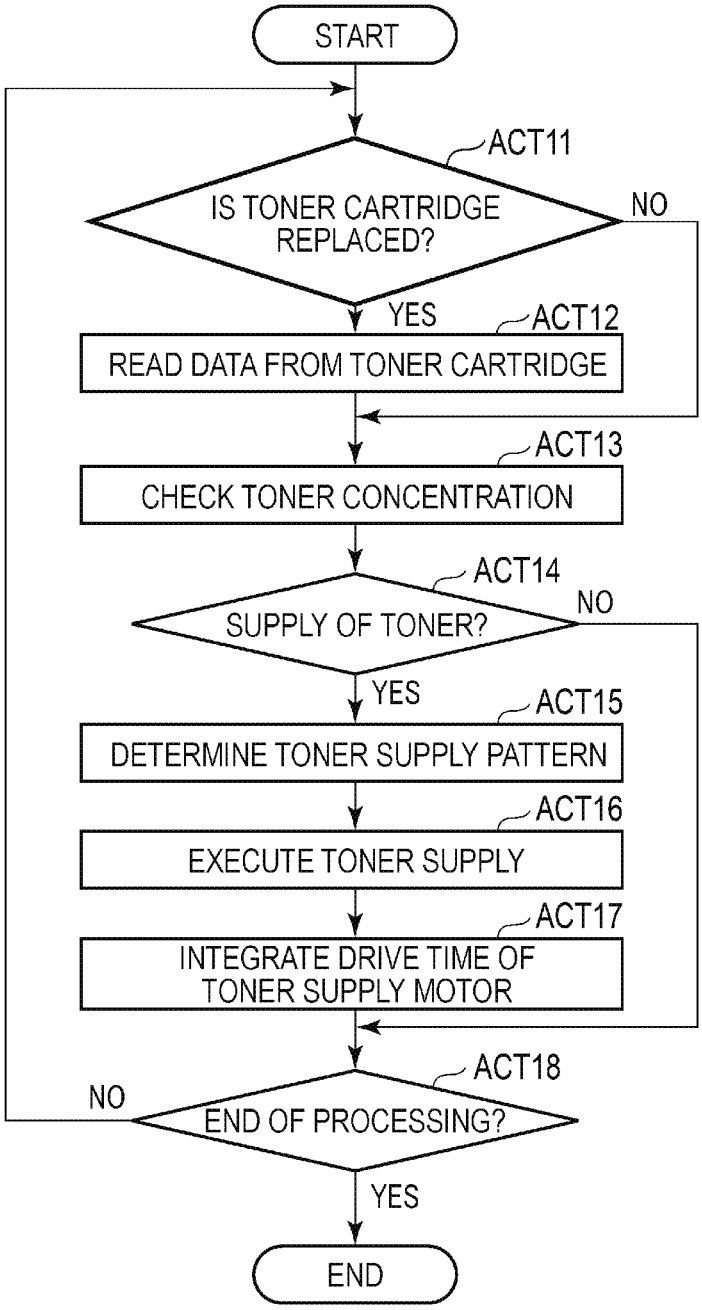
FIG. 3 is an explanatory diagram illustrating an example of an operation of an image forming apparatus according to a first embodiment.

FIG. 3 is a flowchart illustrating processing related to toner supply by the system controller 13.

The processor 21 determines whether the toner cartridge 2 is replaced (ACT 11). For example, the processor 21 determines that the toner cartridge 2 is replaced when the lid of the loading unit 41 is opened. Further, when a unique ID is stored in the toner cartridge 2, it may be determined that the toner cartridge 2 is replaced when the ID of the toner cartridge 2 changes. Further, the processor 21 may be configured to detect the replacement of the toner cartridge 2 by any other means.

When the processor 21 determines that the toner cartridge 2 is not replaced (ACT 11, NO), the processor 21 proceeds to the processing of ACT 13 described later.

When the processor 21 determines that the toner cartridge 2 is replaced (ACT 11, YES), the processor 21 reads data from the memory 53 of the toner cartridge 2 (ACT 12). For example, the processor 21 reads the "identification code", the "toner supply motor count value", the "near-empty threshold" and the like from the memory 53 of the toner cartridge 2 and stores the same in the memory 22 of the system controller 13.

For example, in the memory 53 of the toner cartridge 2, it is assumed that the "identification code" is stored in an address "B001", the "toner supply motor count value" is stored in an address "B002", and the "near-empty threshold" is stored in an address "B003". In this case, the processor 21 stores the "identification code" in an address "A001" of the memory 22, the "toner supply motor count value" in an address "A002", and the "near-empty threshold" in an address "A003".

In addition, the processor 21 executes a warm-up operation when the power of the image forming apparatus 1 is turned on. The processor 21 may read the "identification code", the "toner supply motor count value", the "near-empty threshold", and the like from the memory 53 of the toner cartridge 2 and store the same in the memory 22 during the warm-up operation.

The processor 21 checks the toner concentration in the developer container 81 based on the detected voltage of the ATC sensor 85 (ACT 13).

The processor 21 determines whether to supply toner (ACT 14). The processor 21 determines whether to supply toner based on the toner concentration in the developer container 81 checked in ACT 13 and a preset reference concentration. For example, when the toner concentration is lower than the reference concentration by a predetermined value or higher, the processor 21 determines to cause the toner supply motor 61 to execute a toner supply operation.

When the processor 21 determines not to supply the toner (ACT 14, NO), the processor 21 proceeds to the processing of ACT 18 described later.

Further, when the processor 21 determines to supply the toner (ACT 14, YES), the processor 21 determines a toner supply pattern (ACT 15). For example, the processor 21 determines one of a plurality of toner supply patterns with different drive times of the toner supply motor 61 according to the difference between the toner concentration and the reference concentration.

Specifically, if the toner concentration [%]−reference concentration [%]>−0.3 [%], the processor 21 determines not to supply the toner.

Further, when −0.3 toner concentration [%]−reference concentration [%]>−0.6 [%], the processor 21 determines to supply the toner in a first supply pattern. The first supply pattern is a toner supply pattern that drives the toner supply motor 61 for a predetermined time.

Further, when −0.6≥toner concentration [%]−reference concentration [%]>−0.9 [%], the processor 21 determines to supply the toner in a second supply pattern.

The second supply pattern is a toner supply pattern that drives the toner supply motor 61 for a longer time than the first supply pattern.

Further, when −0.9≥toner concentration [%]−reference concentration [%]>−1.2 [%], the processor 21 determines to supply the toner in a third supply pattern. The third supply pattern is a toner supply pattern that drives the toner supply motor 61 for a longer time than the second supply pattern.

When −1.2≥toner concentration [%]−reference concentration [%]>−1.5 [%], the processor 21 determines to supply the toner in a fourth supply pattern. The fourth supply pattern is a toner supply pattern that drives the toner supply motor 61 for a longer time than the third supply pattern.

Further, when −1.5≥toner concentration [%]−reference concentration [%], the processor 21 determines to supply the toner in a fifth supply pattern. The fifth supply pattern is a toner supply pattern that drives the toner supply motor 61 for a longer time than the fourth supply pattern. The fifth supply pattern is a toner supply pattern of forced supply in which the toner supply motor 61 is driven for a long time because the toner concentration in the developer container 81 is extremely low. The fifth supply pattern may be, for example, a pattern in which a toner supply operation is continuously performed until the toner concentration [%]−reference concentration [%] becomes −1.5% or higher.

The processor 21 executes a toner supply operation by using a determined toner supply pattern (ACT 16). That is, the processor 21 controls the toner supply motor 61 so as to drive the toner delivery mechanism 52 of the toner cartridge 2 according to the determined toner supply pattern.

The processor 21 counts the drive amount (drive time) of the toner supply motor 61 and integrates the same as a toner supply motor count value (ACT 17). The toner supply motor count value is the information stored in the address "A002" of the memory 22 of the system controller 13 as described above. The processor 21 counts the drive time each time the toner supply motor 61 is driven and adds the counted value to the value of the address "A002" of the memory 22. As a result, the toner supply motor count value in the memory 22 of the system controller 13 is sequentially integrated with the drive time of the toner supply motor 61.

The processor 21 determines whether to end the processing (ACT 18). For example, the processor 21 determines to end the processing when an operation to end the operation of the image forming apparatus 1 is performed.

When the processor 21 determines not to end the processing (ACT 18, NO), the processor 21 proceeds to the processing of ACT 11. As a result, the processor 21 repeatedly executes the processing of ACT 11 to ACT 18.

If the processor 21 determines to end the processing (ACT 18, YES), the processor 21 writes the value of the address "A002" of the memory 22 of the system controller 13 to the address "B002" of the memory 53 of the toner cartridge 2, and ends the processing of FIG. 3. As a result, the latest toner supply motor count is stored in the memory 53 of the toner cartridge 2.

Figure 4:
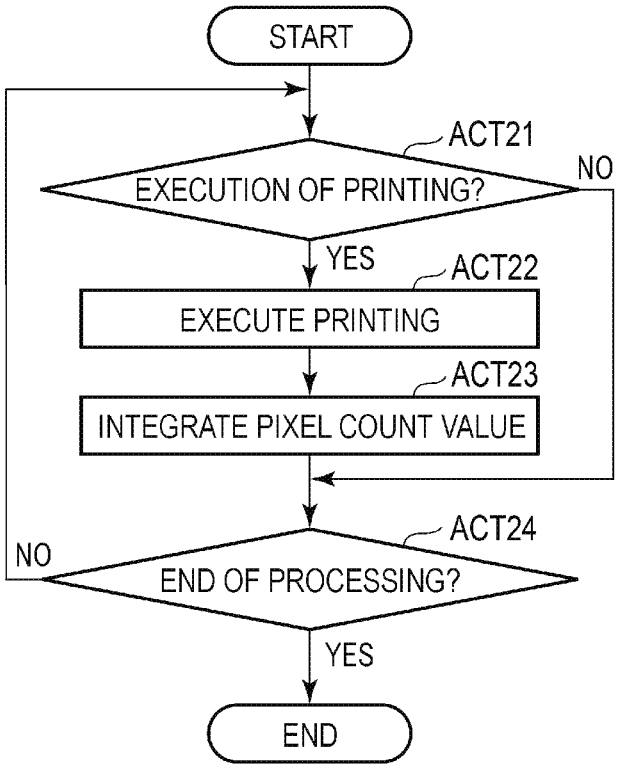
FIG. 4 is an explanatory diagram illustrating an example of the operation of the image forming apparatus.

FIG. 4 is a flowchart illustrating the integration of pixel count values by the system controller 13.

The processor 21 of the system controller 13 executes the processing of FIG. 4 every time printing is executed. For example, the processor 21 may be configured to execute the processing of FIG. 4 each time one sheet is printed, may be configured to execute the processing of FIG. 4 each time one print job is completed, or may be configured to execute the processing of FIG. 4 every time a plurality of sheets are printed. In this example, the processor 21 executes the processing of FIG. 4 every time printing is executed.

The processor 21 determines whether to execute printing (ACT 21).

When the processor 21 determines not to execute printing (ACT 21, NO), the processor 21 proceeds to the processing of ACT 24 described later.

When the processor 21 determines to execute printing (ACT 21, YES), the processor 21 executes printing based on the image data for printing (ACT 22). That is, the processor 21 controls the conveying unit 18, the image forming unit 19, and the fixing device 20 so as to form an image on the print medium P.

The processor 21 counts and integrates the pixel values of the image data used for print, and calculates a pixel count value (ACT 23). The pixel value of the image data corresponds to the number of dots printed for a color. More specifically, the pixel value of the image data corresponds to the number of pixels that the exposure device 43 draws on the photoconductive drum 71. That is, the processor 21 integrates the number of dots printed for the corresponding color of the toner cartridge 2 as a pixel count value. For example, the processor 21 stores the pixel count value in a predetermined area of the memory 22. Every time the processor 21 executes printing and counts the pixel value, the counted pixel value is added to the pixel count value of the predetermined area of the memory 22. As a result, the pixel count value of the memory 22 of the system controller 13 is sequentially integrated for each color of the toner according to printing. The pixel value counted and integrated by the processor 21 is not limited to the number of dots printed as described above, and may be any value as long as the pixel value reflects at least the amount of toner used based on the image data.

The processor 21 determines whether to end the processing (ACT 24). For example, the processor 21 determines to end the processing when an operation to end the operation of the image forming apparatus 1 is performed.

When the processor 21 determines not to end the processing (ACT 24, NO), the processor 21 proceeds to the processing of ACT 21. As a result, the processor 21 repeatedly executes the processing of ACT 21 to ACT 24.

Further, when the processor 21 determines to end the processing (ACT 24, YES), the processing of FIG. 4 ends.

First Embodiment

Next, processing relating to the determination of a toner container supply abnormality in the image forming apparatus 1 according to the first embodiment will be described. The image forming apparatus 1 determines a toner container supply abnormality in the toner cartridge 2 and an empty toner based on the pixel count value and the toner supply motor count value.

Figure 5:
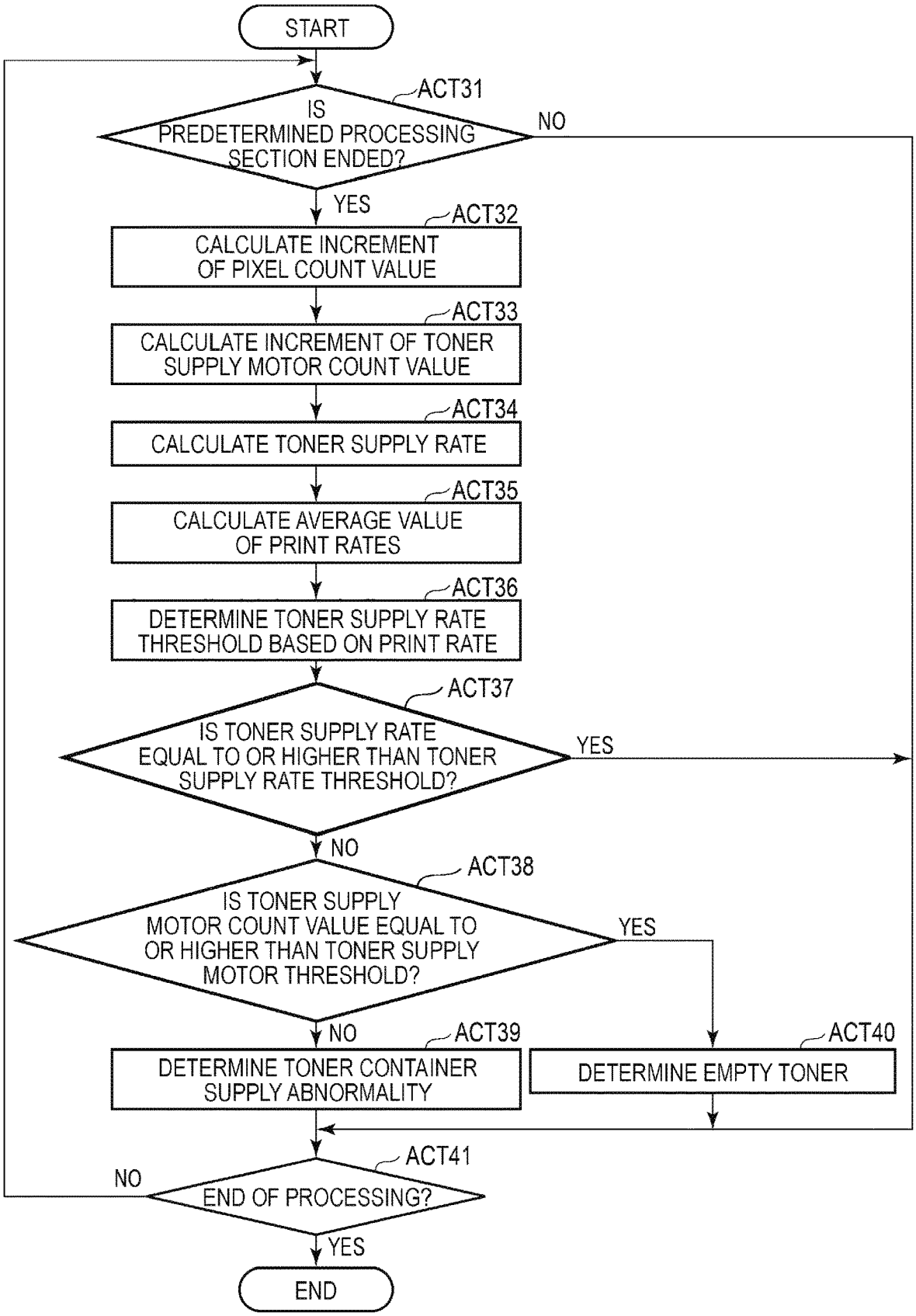
FIG. 5 is an explanatory diagram illustrating an example of the operation of the image forming apparatus.

FIG. 5 is a flowchart illustrating the determination of a toner container supply abnormality and an empty toner by the system controller 13.

The processor 21 of the system controller 13 executes the processing of FIG. 5 every time a predetermined processing section ends. The processing section is a section of processing determined by the number of printed sheets, the pixel count value, or the toner supply motor count value.

For example, the processing section is a section determined by a predetermined number of printed sheets. Specifically, the processor 21 is configured to execute the processing of FIG. 5 every time 50 sheets are printed.

The processing section may be a section until the pixel count value increases by a preset value. In this case, the processor 21 executes the processing of FIG. 5 every time the pixel count value increases by a preset value.

Further, for example, the processing section may be a section until the toner supply motor count value increases by a preset value. In this case, the processor 21 executes the processing of FIG. 5 every time the toner supply motor count value increases by a preset value.

The processor 21 determines whether a predetermined processing section is ended (ACT 31). In this example, the processing section will be described as being determined by the number of printed sheets. In this case, the processor 21 determines whether the predetermined number of printed sheets (for example, 50) is printed.

When the processor 21 determines that the predetermined processing section is not ended (ACT 31, NO), the processor 21 proceeds to the processing of ACT 41 described later.

When the processor 21 determines that the predetermined processing section is ended (ACT 31, YES), the processor 21 calculates the increment of the pixel count value in the processing section (ACT 32). That is, the processor 21 calculates the increment of the pixel count value during the printing of the predetermined number of printed sheets (for example, 50).

Further, the processor 21 calculates the increment of the toner supply motor count value in the processing section (ACT 33). That is, the processor 21 calculates the increment of the toner supply motor count value during the printing of the predetermined number of printed sheets (for example, 50).

The processor 21 calculates a toner supply rate based on the increment of the pixel count value and the increment of the toner supply motor count value (ACT 34). That is, the processor 21 calculates the toner supply rate every time the processing section ends.

The toner supply rate is a ratio of a toner usage amount and a toner supply amount in the processing section. The toner usage amount can be estimated from the pixel count value. The toner supply amount can be estimated from the drive time of the toner supply motor 61. The processor 21 calculates the toner supply rate based on the increment of the pixel count value and the increment of the toner supply motor count value in the processing section. Specifically, the processor 21 calculates a value obtained by dividing the increment of the pixel count value by the increment of the toner supply motor count value, as the toner supply rate. That is, the toner supply rate is the ratio of the toner supply motor count value to the pixel count value.

The processor 21 calculates the average value of the print rates of the image data (ACT 35). The print rate is the ratio of the number of dots to be printed based on image data to the number of dots printable by the image forming apparatus 1 per unit area of an image. The unit area of the image in the print rate is, for example, the area corresponding to the print medium P. For example, the processor 21 calculates the print rates of the plurality of pieces of image data used for printing during the processing section and calculates the average value of the print rates. The processor 21 may be configured to calculate the median value of the print rates instead of the average value of the print rates.

The processor 21 determines a toner supply rate threshold that is a threshold to be compared with the toner supply rate, based on the calculated average value of the print rates of the image data (ACT 36). The processor 21 determines the toner supply rate threshold based on the average value of the print rates and a predetermined control table.

Figure 6:
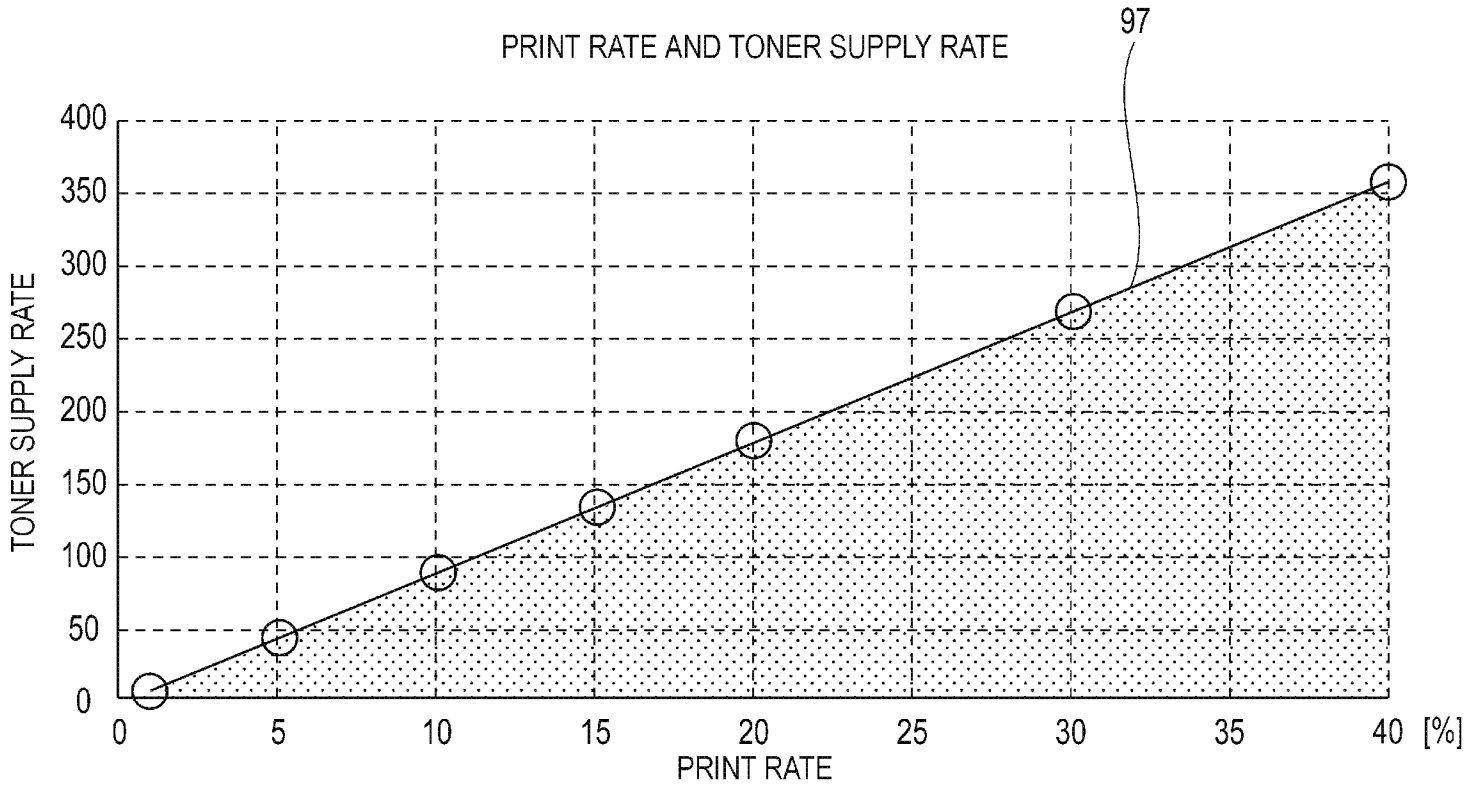
FIG. 6 is an explanatory diagram illustrating an example of the operation of the image forming apparatus.

The toner supply rate threshold is a threshold of the toner supply rate that increases as the print rate of the image data in the processing section increases. FIG. 6 is an explanatory diagram illustrating an example of the toner supply rate threshold. The horizontal axis of FIG. 6 represents the print rate. The vertical axis of FIG. 6 represents the toner supply rate. A graph 97 in FIG. 6 shows the toner supply rate threshold. As illustrated in FIG. 6, the toner supply rate threshold is a value that increases or decreases according to an increase or decrease in the print rate of image data in the processing section. For example, the toner supply rate threshold is a value proportional to the print rate.

As described above, when the toner concentration in the developer container 81 is lower than a reference concentration by a predetermined value or higher, the processor 21 drives the toner supply motor 61 in a supply pattern according to the difference to supply the toner from the toner cartridge 2. When the difference between the toner concentration and the reference concentration is the same (within the equivalent range), the supply patterns are almost the same, and therefore there is no difference in the increment of the toner supply motor count value. However, the pixel count value counted from the image data changes depending on the print rate of the image data. For example, even when the toner concentration is lower than the reference concentration by a predetermined value or higher in a state where the print rate is low, the drive amount of the toner supply motor 61 does not change. Therefore, the toner supply motor count value is excessively integrated. That is, when the print rate is low, the toner supply rate also decreases. Therefore, the toner supply rate threshold is set to be low when the print rate is low and is set to be high when the print rate is high.

The control table is information indicating the relationship between the print rate and the toner supply rate threshold. For example, the control table is configured as a table in which a toner supply rate threshold is associated with each print rate. That is, in the control table, the toner supply rate threshold is set according to the print rate. Further, the control table may be configured as a table in which a toner supply rate threshold is associated with each of a plurality of ranges defined by an upper limit and a lower limit of the print rate. Further, the control table may be configured as a function indicating a proportional relationship between the print rate of the image data and the toner supply rate threshold.

The control table is stored in advance in the memory 22 of the system controller 13, for example. The control table may be stored in the memory 53 of the toner cartridge 2. In this case, the processor 21 reads the control table from the memory 53 of the toner cartridge 2 and stores the same in the memory 22 at the timing of ACT 12 in FIG. 3 or at another timing, for example.

The processor 21 compares the determined toner supply rate threshold with the calculated toner supply rate to determine whether the toner supply rate is equal to or higher than the toner supply rate threshold (ACT 37).

When the processor 21 determines that the toner supply rate is equal to or higher than the toner supply rate threshold (ACT 37, YES), the processor 21 proceeds to the processing of ACT 41 described later.

When the processor 21 determines that the toner supply rate is less than the toner supply rate threshold (ACT 37, NO), the processor 21 determines whether the toner supply motor count value is equal to or higher than a predetermined toner supply motor threshold (ACT 38).

The toner supply motor threshold is a threshold to be compared with the toner supply motor count value, that is, the integrated value of the drive times of the toner supply motor 61. The toner supply motor threshold is stored in advance in the memory 22 of the system controller 13, for example. Further, the toner supply motor threshold may be, for example, a near-empty threshold. That is, as the toner supply motor threshold, a value previously stored in the memory 53 of the toner cartridge 2 may be stored in the memory 22 of the system controller 13.

When the processor 21 determines that the toner supply motor count value is less than a predetermined toner supply motor threshold (ACT 38, NO), the processor 21 determines a toner container supply abnormality (ACT 39).

Since the toner container supply abnormality is an abnormality in the toner cartridge 2, the toner is not supplied from the toner cartridge 2 even if the toner supply motor is operated. The abnormality in the toner cartridge 2 may be, for example, an abnormality of the toner delivery mechanism 52 of the toner cartridge 2, a state where the sealing material that covers the toner supply port of the toner cartridge 2 is still attached, or a state where the toner cartridge 2 has a high temperature during storage and the toner is solidified (stuck state). When such a toner container supply abnormality occurs, the toner concentration in the developer container 81 is not restored because the toner is not supplied from the toner cartridge 2 even if the toner supply motor 61 is operated.

As described above, when the toner supply motor count value is still small (less than the toner supply motor threshold) but the toner supply rate is less than the toner supply rate threshold, the processor 21 determines a toner container supply abnormality. For example, the processor 21 causes the display of the display unit 14 to display information indicating that a toner container supply abnormality occurs. As a result, the processor 21 can prompt the user to check the abnormality of the toner delivery mechanism 52, the sealing material that covers the toner supply port of the toner cartridge 2, the toner stuck in the toner cartridge 2, and the like.

Further, when the processor 21 determines that the toner supply motor count value is equal to or higher than the predetermined toner supply motor threshold (ACT 38, YES), the processor 21 determines an empty toner (ACT 40).

When the remaining amount of the toner in the toner cartridge 2 becomes low, the toner supply rate gradually decreases. This is because the toner supply amount per the drive amount of the toner delivery mechanism 52 of the toner cartridge 2 decreases due to the decrease of the toner in the toner cartridge 2, and the drive time of the toner supply motor 61 for supplying the same amount of toner becomes long.

When the toner supply rate is less than the toner supply rate threshold in a state where the toner supply motor count value is sufficiently increased (equal to or higher than the toner supply motor threshold), the processor 21 determines an empty toner that no toner remains in the toner cartridge 2. For example, the processor 21 causes the display of the display unit 14 to display information indicating an empty toner. As a result, the processor 21 can notify the user that no toner remains in the toner cartridge 2.

In addition to ACT 40, the processor 21 also determines an empty toner based on the detection result of the ATC sensor 85. For example, if the difference between the toner concentration and the reference concentration is equal to or higher than a preset value (for example, the difference<−1.5%) and the toner concentration is not restored even after the forced supply, the processor 21 determines an empty toner. For example, the processor 21 may determine an empty toner based on either or both of the empty toner determination based on the detection result of the ATC sensor 85 and the empty toner determination in ACT 40.

The processor 21 determines whether to end the processing (ACT 41). For example, the processor 21 determines to end the processing when an operation to end the operation of the image forming apparatus 1 is performed.

When the processor 21 determines not to end the processing (ACT 41, NO), the processor 21 proceeds to the processing of ACT 31. As a result, the processor 21 repeatedly executes the processing of ACT 31 to ACT 41.

Further, when the processor 21 determines to end the processing (ACT 41, YES), the processing of FIG. 5 ends.

As described above, the processor 21 of the system controller 13 of the image forming apparatus 1 of the first embodiment calculates the toner supply rate based on the pixel count value that is the integrated value of the pixel values of the image data and the toner supply motor count value that is the integrated value of the drive times of the toner supply motor 61. The processor 21 detects a toner container supply abnormality based on the calculated toner supply rate and the print rate of the image data.

With such a configuration, the image forming apparatus 1 can early detect the state where the toner is not supplied from the toner cartridge 2 based on the toner supply rate in consideration of the print rate. As a result, the image forming apparatus 1 can prompt the user to check the abnormality of the toner delivery mechanism 52, the sealing material that covers the toner supply port of the toner cartridge 2, the toner stuck in the toner cartridge 2, and the like.

Further, the processor 21 detects a toner container supply abnormality when the toner supply motor count value is less than the predetermined toner supply motor threshold (for example, near-empty threshold) and the toner supply rate is less than the toner supply rate threshold. Further, the processor 21 detects an empty toner when the toner supply motor count value is equal to or higher than the predetermined toner supply motor threshold and the toner supply rate is less than the toner supply rate threshold.

With such a configuration, the image forming apparatus 1 determines whether the state in which the toner is not supplied from the toner cartridge 2 is due to the exhaustion of the toner in the toner cartridge 2 or the abnormality in the toner cartridge 2.

Second Embodiment

Next, processing relating to the determination of a toner container supply abnormality in the image forming apparatus 1 according to a second embodiment will be described. Since there is no difference in hardware configuration between the first embodiment and the second embodiment, the difference in control content will be described.

Figure 7:
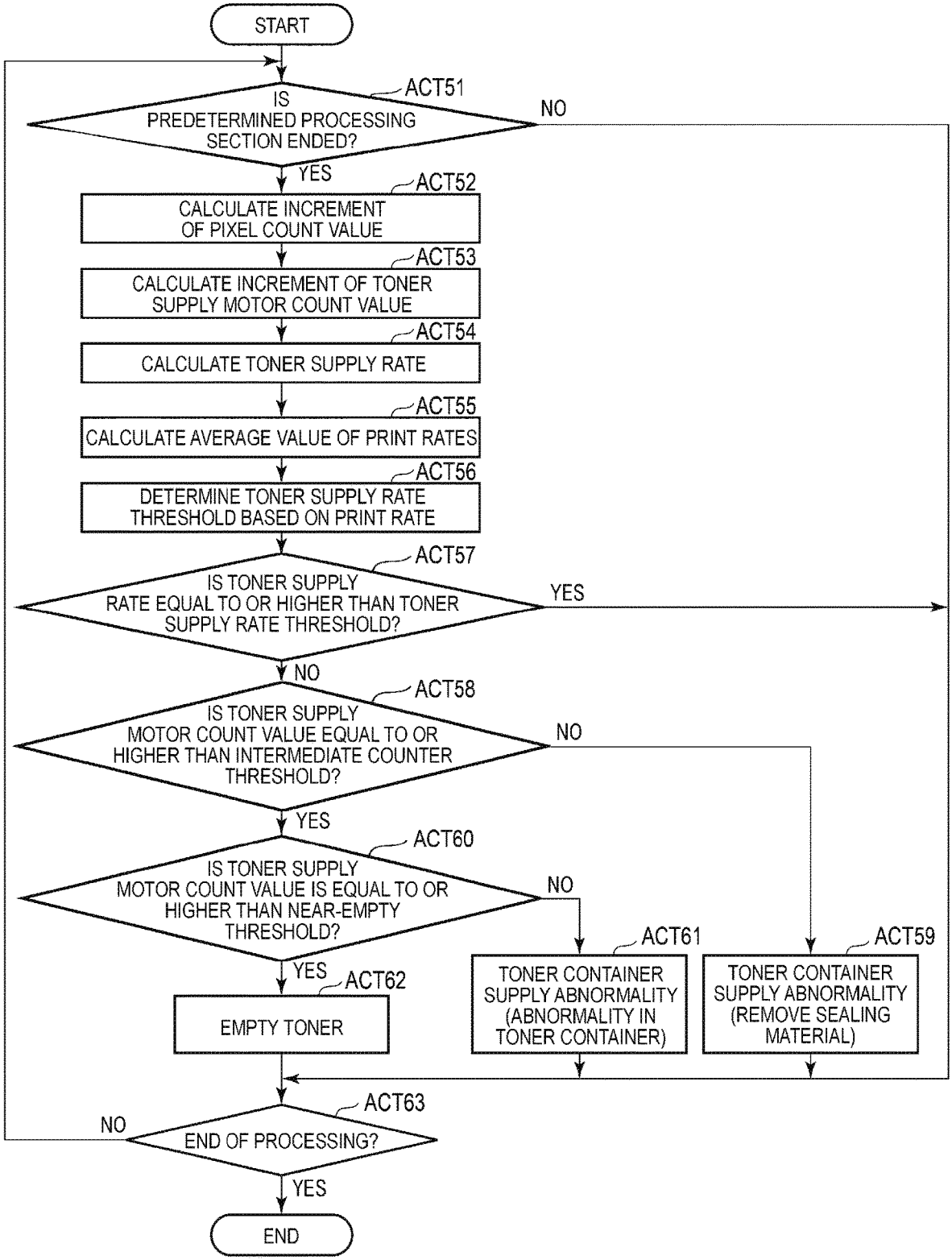
FIG. 7 is an explanatory diagram illustrating an example of an operation of an image forming apparatus according to a second embodiment.

FIG. 7 is a flowchart illustrating the determination of a toner container supply abnormality and an empty toner by the system controller 13 of the second embodiment.

The processor 21 determines whether a predetermined processing section is ended (ACT 51).

When the processor 21 determines that the predetermined processing section is not ended (ACT 51, NO), the processor 21 proceeds to the processing of ACT 63 described later.

When the processor 21 determines that the predetermined processing section is ended (ACT 51, YES), the processor 21 calculates the increment of the pixel count value in the processing section (ACT 52).

Further, the processor 21 calculates the increment of the toner supply motor count value in the processing section (ACT 53).

The processor 21 calculates a toner supply rate based on the increment of the pixel count value and the increment of the toner supply motor count value (ACT 54).

The processor 21 calculates the average value of the print rates of the image data (ACT 55).

The processor 21 determines a toner supply rate threshold that is a threshold to be compared with the toner supply rate, based on the calculated average value of the print rates of the image data (ACT 56).

The processor 21 compares the determined toner supply rate threshold with the calculated toner supply rate and determines whether the toner supply rate is equal to or higher than the toner supply rate threshold (ACT 57).

When the processor 21 determines that the toner supply rate is equal to or higher than the toner supply rate threshold (ACT 57, YES), the processor 21 proceeds to the processing of ACT 63 described later.

When the processor 21 determines that the toner supply rate is less than the toner supply rate threshold (ACT 57, NO), the processor 21 determines whether the toner supply motor count value is equal to or higher than the predetermined toner supply motor threshold (intermediate counter threshold) (ACT 58).

The intermediate counter threshold is one of the toner supply motor thresholds and is a threshold to be compared with the toner supply motor count value, that is, the integrated value of the drive times of the toner supply motor 61. The intermediate counter threshold is stored in advance in the memory 22 of the system controller 13, for example. Further, as the intermediate counter threshold, for example, a value previously stored in the memory 53 of the toner cartridge 2 may be stored in the memory 22 of the system controller 13. For example, when the toner cartridge 2 is replaced or when the power is turned on, the processor 21 of the system controller 13 reads the intermediate counter threshold from the memory 53 of the toner cartridge 2 and stores the same in the memory 22.

When the processor 21 determines that the toner supply motor count value is less than the intermediate counter threshold (ACT 58, NO), the processor 21 determines a toner container supply abnormality (the sealing material for sealing is not removed) (ACT 59). In this case, the processor 21 causes the display of the display unit 14 to display information indicating that a toner container supply abnormality occurs, or information that prompts to remove the sealing material for sealing. As a result, the processor 21 can prompt the user to check the sealing material that covers the toner supply port of the toner cartridge 2.

When the processor 21 determines that the toner supply motor count value is equal to or higher than the intermediate counter threshold (ACT 58, YES), the processor 21 determines whether the toner supply motor count value is equal to or higher than the predetermined toner supply motor threshold (near-empty threshold) (ACT 60).

When the processor 21 determines that the toner supply motor count value is less than the near-empty threshold (ACT 60, NO), the processor 21 determines that there is a toner container supply abnormality, that is, there is an abnormality of the toner delivery mechanism 52 of the toner cartridge 2, or that the toner in the toner cartridge 2 is in a solidified state (stuck state) (ACT 61). In this case, the processor 21 causes the display of the display unit 14 to display information indicating that there is an abnormality of the toner delivery mechanism 52 of the toner cartridge 2 or that the toner in the toner cartridge 2 is in a solidified state (stuck state). Accordingly, the processor 21 can prompt the user to check the abnormality of the toner delivery mechanism 52 or the stuck state of the toner in the toner cartridge 2.

Further, when the processor 21 determines that the toner supply motor count value is equal to or higher than the near-empty threshold (ACT 60, YES), the processor 21 determines an empty toner (ACT 62). In this case, the processor 21 causes the display of the display unit 14 to display information indicating an empty toner. As a result, the processor 21 can notify the user that no toner remains in the toner cartridge 2.

The processor 21 determines whether to end the processing (ACT 63). For example, the processor 21 determines to end the processing when an operation to end the operation of the image forming apparatus 1 is performed.

When the processor 21 determines not to end the processing (ACT 63, NO), the processor 21 proceeds to the processing of ACT 51. As a result, the processor 21 repeatedly executes the processing of ACT 51 to ACT 63.

Further, when the processor 21 determines to end the processing (ACT 63, YES), the processing of FIG. 7 ends.

As described above, the processor 21 of the system controller 13 of the image forming apparatus 1 according to the second embodiment determines a toner container supply abnormality when the toner supply motor count value is less than a preset intermediate counter threshold and the toner supply rate is less than the toner supply rate threshold. Further, the processor 21 prompts the user to remove the sealing material. As a result, it is possible to early notify the user that the sealing material for sealing is still attached to the toner supply port of the toner cartridge 2.

Further, the processor 21 determines a toner container supply abnormality when the toner supply motor count value is equal to or higher than the preset intermediate counter threshold and less than the near-empty threshold and the toner supply rate is less than the toner supply rate threshold. Further, the processor 21 prompts the user to check the toner delivery mechanism 52 of the toner cartridge 2 or check the toner stuck in the toner cartridge 2. As a result, it is possible to early notify the user that an abnormality occurs in the toner cartridge 2.

The toner supply motor threshold may be further subdivided. This makes it possible to increase the number of items that notify the user of various situations or prompt the user to check.

The functions described in each of the above-described embodiments are not limited to being configured by using hardware and can be realized by using software to read a program describing each function into a computer. Further, each function may be configured by appropriately selecting either software or hardware.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a photoconductive image carrier;

an exposure device configured to expose the photoconductive image carrier based on image data;

a developing device configured to form a toner image on the photoconductive image carrier by toner supplied from a toner cartridge;

a toner concentration sensor configured to detect toner concentration in the developing device;

a toner supply motor configured to supply the toner from the toner cartridge to the developing device based on the toner concentration; and a processor configured to detect a toner container supply abnormality based on a toner supply rate and a print rate of the image data, the toner supply rate being calculated based on a pixel count value based on an integrated value of pixel values of the image data and a toner supply motor count value based on an integrated value of drive times of the toner supply motor.

2. The image forming apparatus according to claim 1, wherein the processor is further configured to calculate the toner supply rate based on an increment of the pixel count value and an increment of the toner supply motor count value in a predetermined processing section, determine a toner supply rate threshold based on a print rate of the image data in the processing section, and detect a toner container supply abnormality when the toner supply rate is less than the toner supply rate threshold.

3. The image forming apparatus according to claim 2, wherein the processor is further configured to detect a toner container supply abnormality when the toner supply motor count value is less than a predetermined toner supply motor threshold and the toner supply rate is less than the toner supply rate threshold, and detect an empty toner cartridge when the toner supply motor count value is equal to or higher than the predetermined toner supply motor threshold and the toner supply rate is less than the toner supply rate threshold.

4. The image forming apparatus according to claim 2, wherein the toner supply rate threshold is a value that decreases when the print rate of the image data in the processing section decreases, and increases when the print rate increases.

5. The image forming apparatus according to claim 1, wherein the developing device is configured to form the toner image on the photoconductive image carrier by toner supplied from a plurality of toner cartridges; and further comprising a plurality of toner supply motors, each configured to supply the toner from a corresponding one of the plurality of toner cartridges to the developing device based on the toner concentration.

6. The image forming apparatus according to claim 5, wherein the processor is further configured to detect a unique identification code from each of the plurality of toner cartridges.

7. The image forming apparatus according to claim 1, wherein the processor is further configured to detect a unique identification code from the toner cartridge.

8. A method for controlling an image forming apparatus including a photoconductive image carrier, an exposure device that exposes the photoconductive image carrier based on image data, a developing device that forms a toner image on the photoconductive image carrier by toner supplied from a toner cartridge, a toner concentration sensor that detects toner concentration in the developing device, a toner supply motor that supplies the toner from the toner cartridge to the developing device based on the toner concentration, and a processor, the method comprising:

detecting a toner container supply abnormality based on a toner supply rate and a print rate of the image data, the toner supply rate being calculated based on a pixel count value based on an integrated value of pixel values of the image data and a toner supply motor count value based on an integrated value of drive times of the toner supply motor.

9. The method according to claim 8, further comprising:

calculating the toner supply rate based on an increment of the pixel count value and an increment of the toner supply motor count value in a predetermined processing section;

determining a toner supply rate threshold based on a print rate of the image data in the processing section; and detecting a toner container supply abnormality when the toner supply rate is less than the toner supply rate threshold.

10. The method according to claim 9, further comprising:

detecting a toner container supply abnormality when the toner supply motor count value is less than a predetermined toner supply motor threshold and the toner supply rate is less than the toner supply rate threshold; and detecting an empty toner cartridge when the toner supply motor count value is equal to or higher than the predetermined toner supply motor threshold and the toner supply rate is less than the toner supply rate threshold.

11. The method according to claim 9, wherein the toner supply rate threshold is a value that decreases when the print rate of the image data in the processing section decreases, and increases when the print rate increases.

12. The method according to claim 8, further comprising:

detecting a unique identification code from the toner cartridge.

13. The method according to claim 8, wherein the developing device is configured to form the toner image on the photoconductive image carrier by toner supplied from a plurality of toner cartridges, and a plurality of toner supply motors, each configured to supply the toner from a corresponding one of the plurality of toner cartridges to the developing device based on the toner concentration.

14. A toner processing system, comprising:

a developing device configured to form a toner image on a photoconductive image carrier by toner supplied from a toner cartridge;

a toner concentration sensor configured to detect toner concentration in the developing device;

a toner supply motor configured to supply the toner from the toner cartridge to the developing device based on the toner concentration; and a processor configured to detect a toner container supply abnormality based on a toner supply rate and a print rate of the image data, the toner supply rate being calculated based on a pixel count value based on an integrated value of pixel values of image data and a toner supply motor count value based on an integrated value of drive times of the toner supply motor.

15. The toner processing system according to claim 14, wherein the processor is further configured to calculate the toner supply rate based on an increment of the pixel count value and an increment of the toner supply motor count value in a predetermined processing section, determine a toner supply rate threshold based on a print rate of the image data in the processing section, and detect a toner container supply abnormality when the toner supply rate is less than the toner supply rate threshold.

16. The toner processing system according to claim 15, wherein the processor is further configured to detect a toner container supply abnormality when the toner supply motor count value is less than a predetermined toner supply motor threshold and the toner supply rate is less than the toner supply rate threshold, and detect an empty toner cartridge when the toner supply motor count value is equal to or higher than the predetermined toner supply motor threshold and the toner supply rate is less than the toner supply rate threshold.

17. The toner processing system according to claim 15, wherein the toner supply rate threshold is a value that decreases when the print rate of the image data in the processing section decreases, and increases when the print rate increases.

18. The toner processing system according to claim 14, wherein the developing device is configured to form the toner image on the photoconductive image carrier by toner supplied from a plurality of toner cartridges; and further comprising a plurality of toner supply motors, each configured to supply the toner from a corresponding one of the plurality of toner cartridges to the developing device based on the toner concentration.

19. The toner processing system according to claim 18, wherein the processor is further configured to detect a unique identification code from each of the plurality of toner cartridges.

20. The toner processing system according to claim 14, wherein the processor is further configured to detect a unique identification code from the toner cartridge.

* * * * *